US010536771B2

(12) United States Patent
Ji et al.

(10) Patent No.: US 10,536,771 B2
(45) Date of Patent: Jan. 14, 2020

(54) DYNAMIC RECEIVER WITH RESONANCE PROTECTOR FOR EARPHONE

(71) Applicant: EM-TECH. Co., Ltd., Busan (KR)

(72) Inventors: Yong Ju Ji, Gyeongsangnam-do (KR); Jung Ho Kang, Gyeongsangnam-do (KR)

(73) Assignee: EM-TECH. Co., Ltd., Busan (KR)

( * ) Notice: Subject to any disclaimer, the term of this patent is extended or adjusted under 35 U.S.C. 154(b) by 0 days.

(21) Appl. No.: 15/987,595

(22) Filed: May 23, 2018

(65) Prior Publication Data

US 2018/0352323 A1 Dec. 6, 2018

(30) Foreign Application Priority Data

Jun. 1, 2017 (KR) ..... 10-2017-0068521

(51) Int. Cl.

| | |
|---|---|
| ***H04R 1/10*** | (2006.01) |
| ***H04R 1/28*** | (2006.01) |
| ***H04R 3/08*** | (2006.01) |

(52) U.S. Cl.

CPC ..... *H04R 1/2884* (2013.01); *H04R 1/1058* (2013.01); *H04R 3/08* (2013.01); *H04R 1/1016* (2013.01)

(58) Field of Classification Search

CPC .. H04R 1/1016; H04R 1/1058; H04R 1/2882; H04R 3/08

See application file for complete search history.

(56) References Cited

U.S. PATENT DOCUMENTS

| | | | | |
|---|---|---|---|---|
| 3,586,794 | A * | 6/1971 | Michaelis | H04R 1/225 181/129 |
| 2006/0285711 | A1 | 12/2006 | Song | |
| 2007/0116321 | A1 | 5/2007 | Jang et al. | |
| 2016/0066111 | A1 | 3/2016 | Epping et al. | |
| 2018/0262842 | A1* | 9/2018 | Komatsu | H04R 7/22 |

FOREIGN PATENT DOCUMENTS

| | | | |
|---|---|---|---|
| CN | 1972333 | A | 5/2007 |
| CN | 101536544 | A | 9/2009 |
| CN | 101919265 | A | 12/2010 |
| CN | 102318368 | A | 1/2012 |
| CN | 104080029 | A | 10/2014 |
| CN | 104754454 | A | 7/2015 |
| CN | 104754474 | A | 7/2015 |
| CN | 104936110 | A | 9/2015 |
| CN | 105556987 | A | 5/2016 |

* cited by examiner

*Primary Examiner* — Brian Ensey
(74) *Attorney, Agent, or Firm* — Murphy, Bilak & Homiller, PLLC

(57) ABSTRACT

A dynamic receiver for an earphone is provided. The dynamic receiver has a Helmholtz resonance space provided on a protector. The dynamic receiver includes: a frame; a magnetic circuit disposed in the frame; a vibration system disposed in the frame and configured to generate sound by a mutual electromagnetic force with the magnetic circuit; and a protector coupled to the frame and configured to protect components disposed in the frame. The protector includes a sound emitting hole passing through the protector and emitting sound generated in the frame to the outside, and a resonance space defined on a top surface of the protector.

12 Claims, 7 Drawing Sheets

DYNAMIC RECEIVER WITH RESONANCE PROTECTOR FOR EARPHONE

PRIORITY CLAIM

The present application claims priority to Korean Patent Application No. 10-2017-0068521 filed on 1 Jun. 2017, the content of said application incorporated herein by reference in its entirety.

TECHNICAL FIELD

The present invention relates to a dynamic receiver with a resonance protector for an earphone.

BACKGROUND

Earphones, especially canal-type earphones, which are used closely in the user's ears, become a major cause of hearing loss of the user in the case of reproducing an excessive sound pressure at high frequencies.

In order to solve the foregoing problem, a resonance space is provided in an earphone using the principle of a Helmholtz resonator, such that it acts as a sound absorption circuit in the Helmholtz resonance region to reduce a sound pressure level.

US 2016/0066111 discloses an earphone using the principle of the Helmholtz resonator. Referring to FIG. 1, an ear canal earpiece 1100 includes a sound converter 1110, first to third sound guide units 1120, 1130 and 1140, and a sound barrier 1150 positioned in the region of the third sound guide unit. In addition, the earpiece includes a Helmholtz resonator 1170 in the sound barrier 1150. The Helmholtz resonator 1170 includes a first open end 1171 facing the ear and a space 1172 positioned away from the ear.

The Helmholtz resonator includes an element 1173 that forms an acoustic mass and the space 1172 that is blocked. The Helmholtz resonator acts as a sound absorption circuit, and thus reduces a sound pressure level inside the ear canal in the Helmholtz resonance region.

However, the earphone using the principle of the Helmholtz resonator has a disadvantage in that the whole earpiece should be replaced to change the resonance point of the Helmholtz resonator because the Helmholtz resonator is disposed in the earpiece.

SUMMARY

An object of the present invention is to provide a dynamic receiver for an earphone in which a Helmholtz resonance space is provided on a protector.

According to an aspect of the present invention for achieving the above object, there is provided a dynamic receiver with a resonance protector for an earphone, including: a frame; a magnetic circuit disposed in the frame; a vibration system disposed in the frame to generate sound by a mutual electromagnetic force with the magnetic circuit; and a protector coupled to the frame to protect components disposed in the frame, wherein the protector includes a sound emitting hole passing through the protector and emitting sound generated in the frame to the outside and a resonance space defined on the top surface of the protector.

In some embodiments, the resonance space may be defined by a recess portion formed on the top surface of the protector.

In some embodiments, the resonance space may be partitioned with the sound emitting hole by a partition wall.

In some embodiments, the partition wall positioned on the outer periphery of the sound emitting hole may not have a constant thickness.

In some embodiments, a channel for allowing the resonance space and the sound emitting hole to communicate with each other may be defined on the partition wall.

In some embodiments, there may be one or more resonance spaces.

In some embodiments, the bottom surface of the protector may have a curvature corresponding to that of the top surface of the vibration system.

In the dynamic receiver with the resonance protector for the earphone as provided by the present invention, the Helmholtz resonance space is provided on the protector of the receiver, which makes it possible to eliminate the Helmholtz resonance space in the earpiece of the earphone.

In addition, the dynamic receiver with the resonance protector for the earphone as provided by the present invention has an advantage in that it is possible to finely tune the Helmholtz resonance space merely by changing the volume of the resonance space defined on the protector or the length of the channel for connecting the resonance space to the sound emitting hole.

Those skilled in the art will recognize additional features and advantages upon reading the following detailed description, and upon viewing the accompanying drawings.

BRIEF DESCRIPTION OF THE DRAWINGS

The elements of the drawings are not necessarily to scale relative to each other. Like reference numerals designate corresponding similar parts. The features of the various illustrated embodiments can be combined unless they exclude each other. Embodiments are depicted in the drawings and are detailed in the description which follows.

DETAILED DESCRIPTION

Hereinafter, a preferred embodiment of a dynamic receiver with a resonance protector for an earphone according to the present invention will be described in detail with reference to the accompanying drawings.

Figure 1:
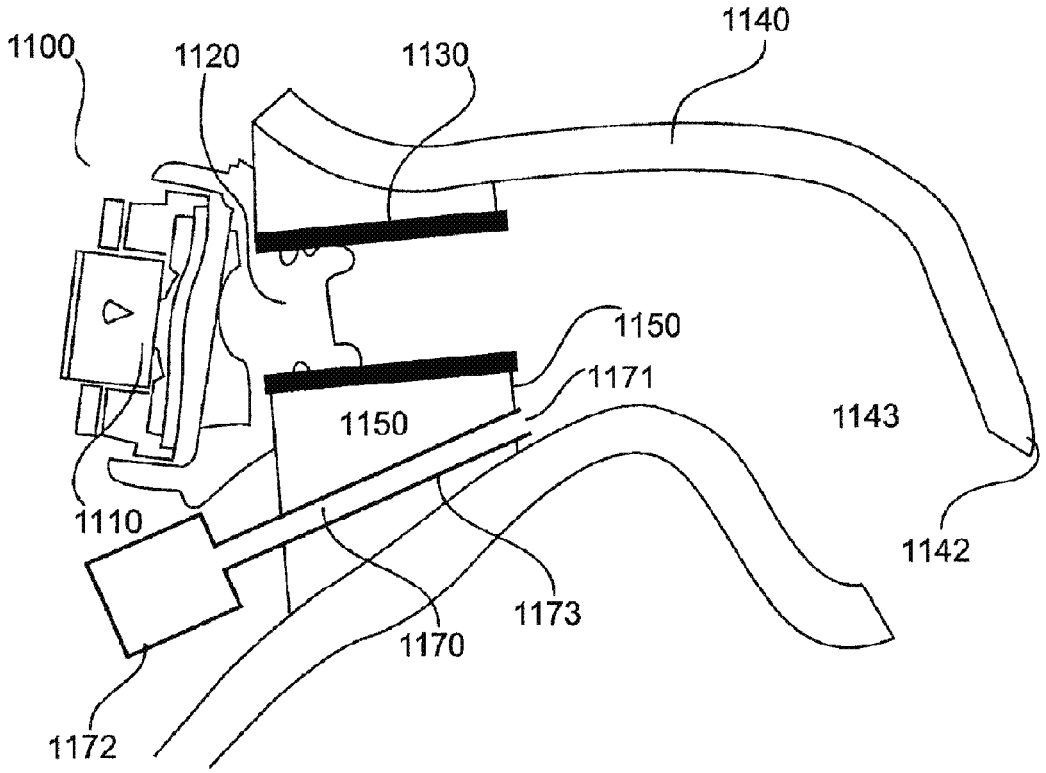
FIG.1 (PRIOR ART)
FIG. 1 is a view showing an example of a conventional earphone using the Helmholtz resonance principle.
Figure 2:
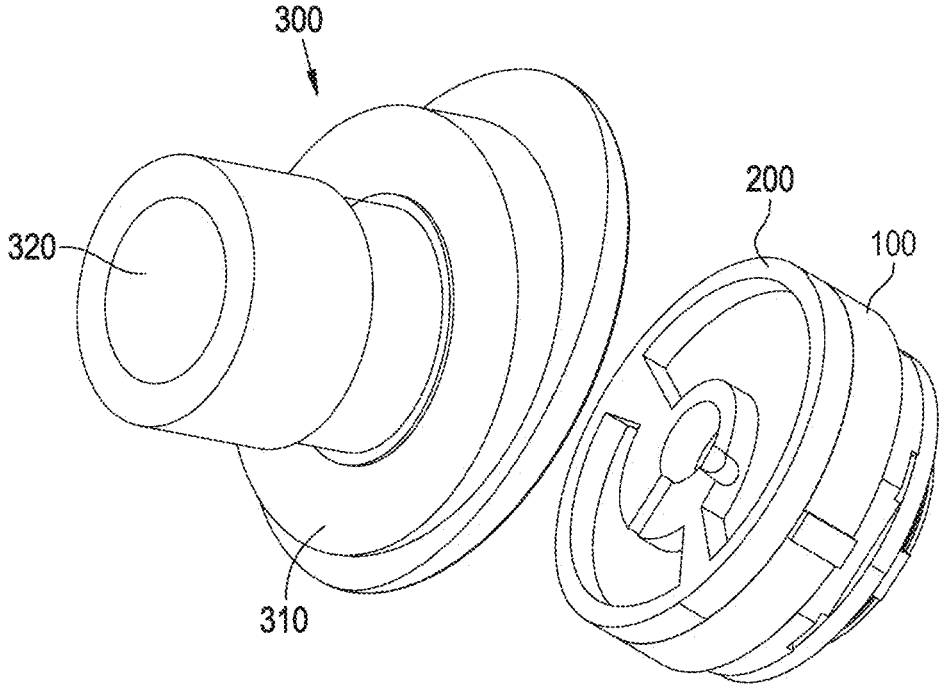
FIG. 2 is a perspective view showing a dynamic receiver with a resonance protector for an earphone according to an embodiment of the present invention, when seen from the top.
Figure 3:
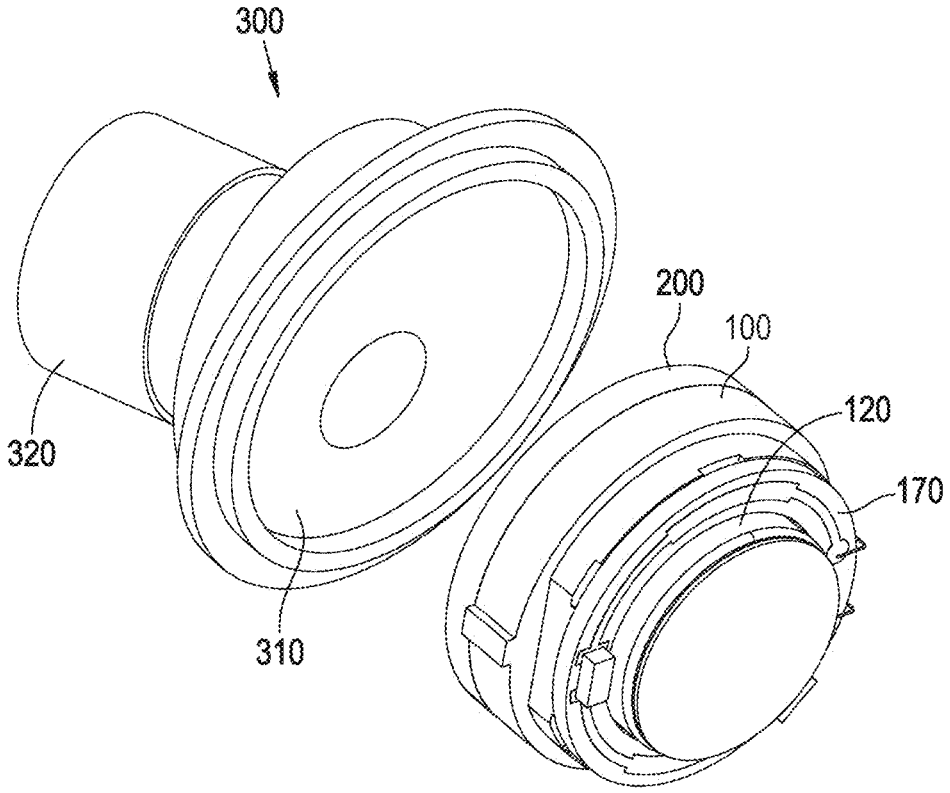
FIG. 3 is a perspective view showing the dynamic receiver with the resonance protector for the earphone according to the embodiment of the present invention, when seen from the bottom.
Figure 4:
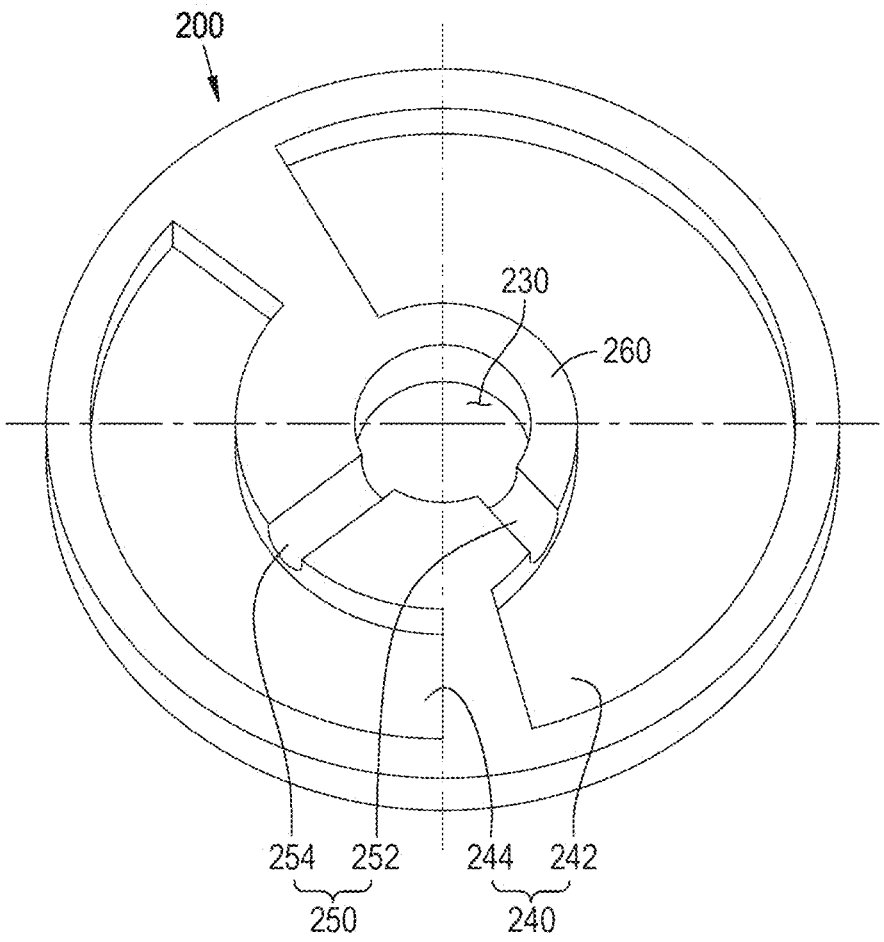
FIG. 4 is a view showing the resonance protector provided in the dynamic receiver with the resonance protector for the earphone according to the embodiment of the present invention.
Figure 5:
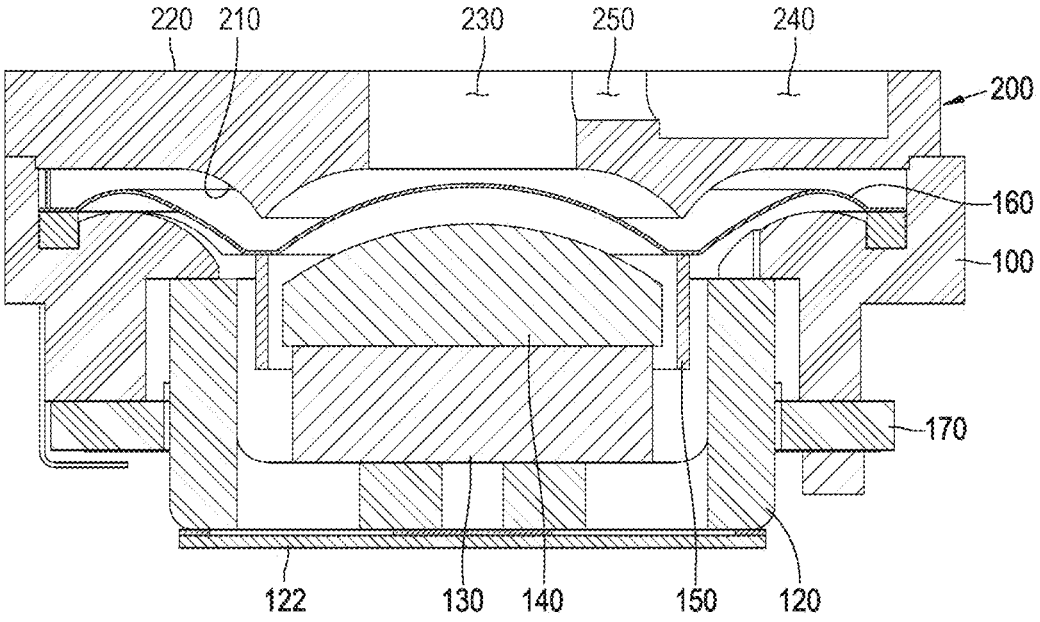
FIG. 5 is a sectional view showing the dynamic receiver with the resonance protector for the earphone according to the embodiment of the present invention.

FIG. 2 is a perspective view showing the dynamic receiver with the resonance protector for the earphone according to the embodiment of the present invention, when seen from the top, FIG. 3 is a perspective view showing the dynamic receiver with the resonance protector for the earphone according to the embodiment of the present invention, when seen from the bottom, FIG. 4 is a view showing the resonance protector provided in the dynamic receiver with the resonance protector for the earphone according to the embodiment of the present invention, and FIG. 5 is a sectional view showing the dynamic receiver with the resonance protector for the earphone according to the embodiment of the present invention.

An earpiece 300, which is not a component of the dynamic receiver with the resonance protector for the earphone according to the present invention, is illustrated in FIGS. 2 and 3 merely to show the coupling relationship with the dynamic receiver with the resonance protector for the earphone.

In the dynamic receiver with the resonance protector for the earphone according to the embodiment of the present invention, a magnetic circuit composed of a yoke 120, a magnet 130 and a top plate 140 is disposed in a frame 100, and a vibration system composed of a voice coil 150 and a diaphragm 160 to vibrate with the magnetic circuit by a mutual electromagnetic force and generate sound is also disposed therein. The yoke 120 is formed in a cylindrical shape with an open top surface, a bottom surface and a side surface, with a vent hole formed in the bottom surface thereof to facilitate the vibration of the diaphragm 160. A screen 122 may be attached to the bottom surface of the yoke 120 to prevent foreign substances from entering through the vent hole. Meanwhile, a PCB 170 may be mounted on the bottom surface of the frame 100 to transfer a signal to the voice coil 150.

An upwardly-protruding circular center dome is provided at the center of the diaphragm 160 and an upwardly-protruding annular side dome is provided on the outer periphery of the center dome. The voice coil 150 is attached between the center dome and the side dome, with a bottom end positioned in a magnetic gap between the yoke 120 and the magnet 130 and the top plate 140. The top surface of the top plate 140 is not formed in a plane shape but in a upwardly-protruding convex shape, corresponding to the shape of the center dome.

A protector 200 is disposed at the topmost portion of the frame 100. The protector 200 serves to protect components disposed in the frame 100. Further, the protector 200 according to the present invention serves to guide sound to the earpiece 300 and acts as a Helmholtz resonator. A sound emitting hole 230 passing through the protector 200 and emitting sound generated in the frame 100 to the outside is provided at the center of the protector 200. In addition, a resonance space 240, which is defined by a recess portion of a certain depth, is provided on the top surface 220 of the protector 200. As the resonance space 240 is defined by the recess portion, the top surface is open. However, when the top surface 220 of the protector 200 and the bottom surface 310 of the earpiece 300 are coupled to each other, they can define a blocked space.

The resonance space 240 is communicated with the sound emitting hole 230 through a channel 250, and thus acts as a Helmholtz resonator. Referring to FIG. 4, the resonance space 240 may preferably include two or more resonance spaces 242 and 244 of different volumes, and accordingly, the channel 250 may include two or more channels 252 and 254 for connecting each of the resonance spaces 242 and 244 to the sound emitting hole 230. Since the resonance spaces 242 and 244 are defined by recess portions depressed from the top surface, there is a partition wall 260 between each of the resonance spaces 242 and 244 and the sound emitting hole 230. The channels 252 and 254 are formed in the partition wall 260 lying between the resonance spaces 242 and 244 and the sound emitting hole 230. Here, the partition wall 260 between the resonance spaces 242 and 244 and the sound emitting hole 230 does not have a constant thickness. In the drawing, it can be seen that the partition wall 260 between the resonance spaces 242 and 244 and the sound emitting hole 230 has a thickness gradually increasing in the clockwise direction. Therefore, there is an advantage of changing the lengths of the channels 252 and 254 merely by changing the positions of the channels 252 and 254.

Meanwhile, the bottom surface 210 of the protector 200 is formed with a curvature corresponding to that of the diaphragm 160. It is thus possible to smoothly emit sound generated in the diaphragm 160 to the sound emitting hole 230.

Figure 6:
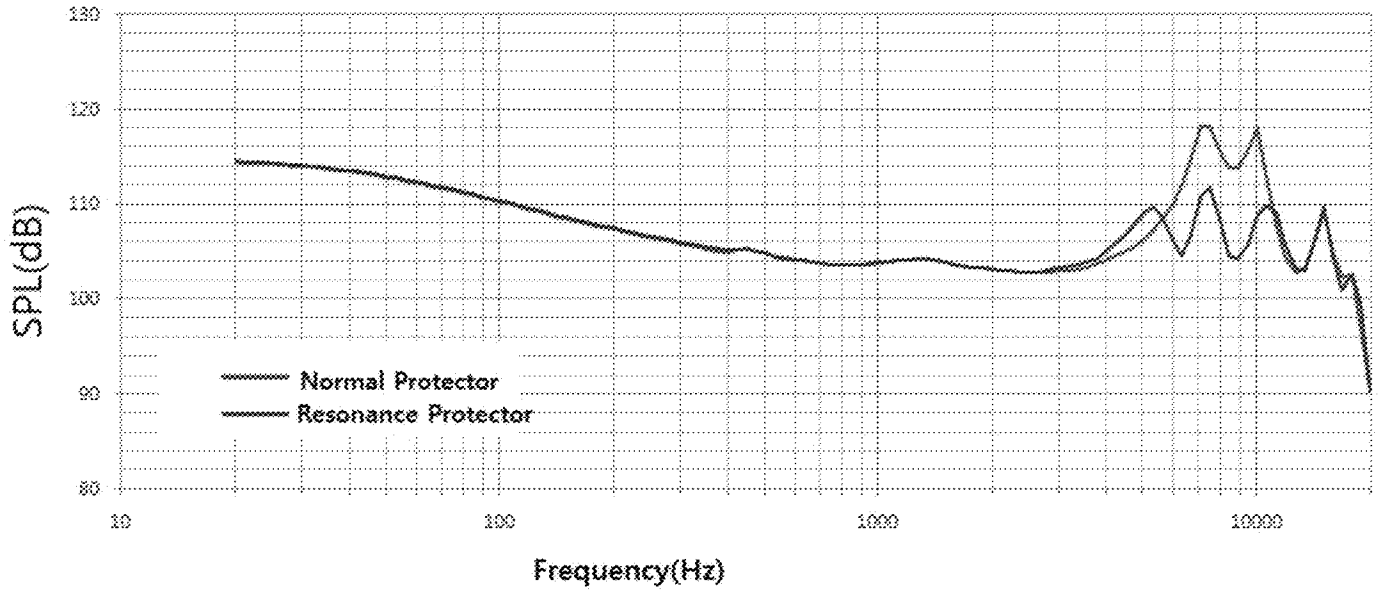
FIG. 6 is a graph showing a sound pressure level by frequencies of the dynamic receiver with the resonance protector for the earphone according to the embodiment of the present invention and the dynamic receiver with the normal protector for the earphone.

FIG. 6 is a graph showing a sound pressure level by frequencies of the dynamic receiver with the resonance protector for the earphone according to the embodiment of the present invention and the dynamic receiver with the normal protector for the earphone.

Firstly, in the sound pressure level by frequencies of the dynamic receiver with the normal protector for the earphone as indicated by the red line, it can be seen that the sound pressure level sharply increases around 7 kHz and 10 kHz. It results from the distance between the earphone receiver and the user's eardrum, i.e., resonance is generated around 7 kHz and 10 kHz, which increases the sound pressure level.

In the sound pressure level by frequencies of the dynamic receiver with the resonance protector for the earphone as indicated by the blue line, Helmholtz resonance is generated around 7 kHz and 10 kHz by the resonance spaces 242 and 244. Linearized high frequency band reproduction becomes possible by suppressing the conventional 7 kHz and 10 kHz resonance in a reverse phase. It can be seen that, as compared with the conventional dynamic receiver, the dynamic receiver of the present invention reduces the sound pressure level to about 6 dB at the 7 kHz peak and to about 8 dB at the 10 kHz peak.

Figure 7:
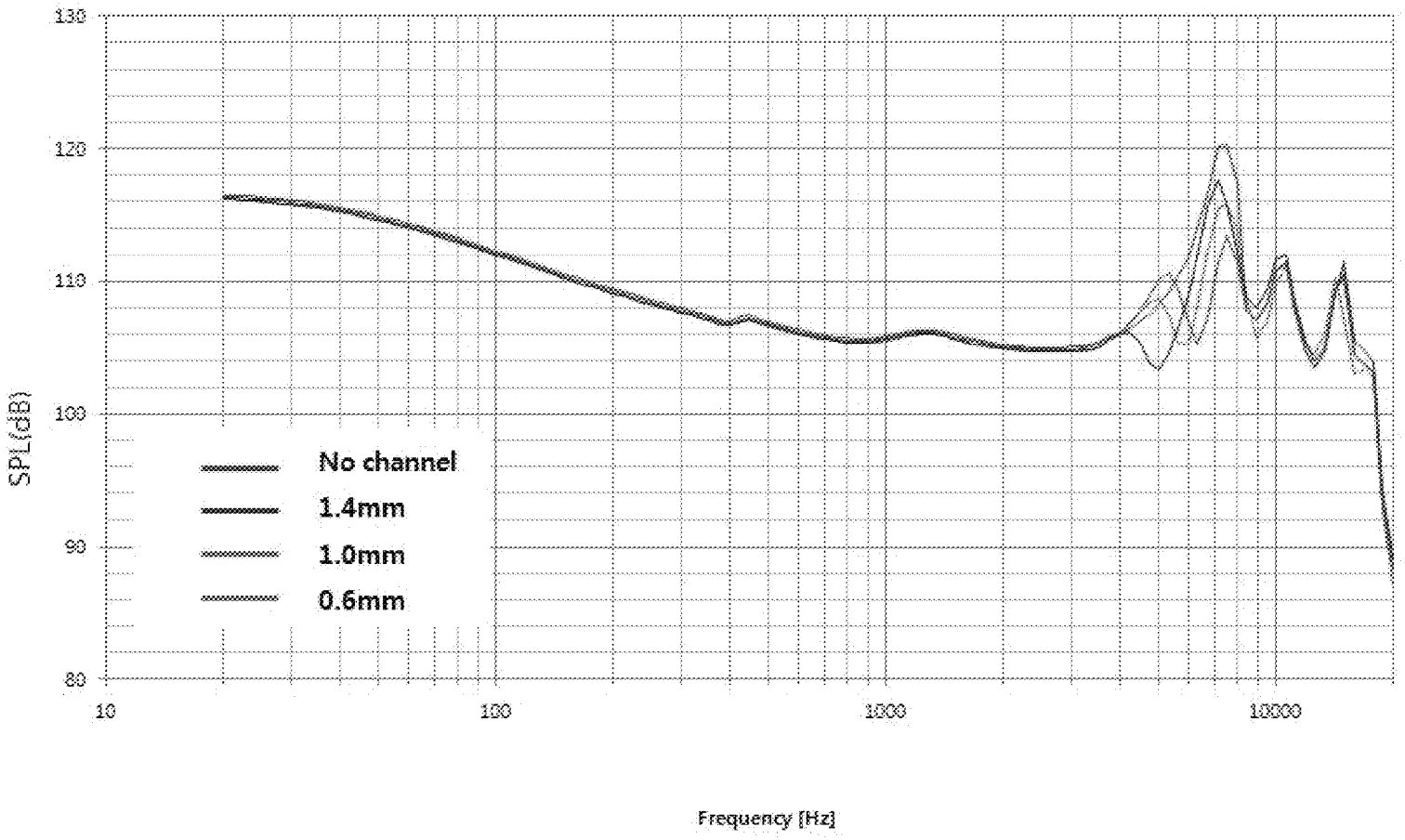
FIG. 7 is a graph showing changes in the sound pressure level, when the length of the channel of the dynamic receiver with the resonance protector for the earphone according to the embodiment of the present invention is changed.

FIG. 7 is a graph showing changes in the sound pressure level, when the length of the channel of the dynamic receiver with the resonance protector for the earphone according to the embodiment of the present invention is changed.

The frequency generated by Helmholtz resonance may be represented as follows, using the volume V of the resonance space 242 and 244, the length l of the channel 252 and 254, the sectional area S of the channel 252 and 254 and the speed c of the sound wave:

$$f_0 = \frac{c}{2\pi}\sqrt{\frac{S}{lV}}$$

Referring to FIG. 4, the resonance space 240 includes a first resonance space 242 of a large volume and a second resonance space 244 of a small volume, and the channel 250 includes a first channel 252 for connecting the first resonance space 242 to the sound emitting hole 230 and a second channel 254 for connecting the second resonance space 244 to the sound emitting hole 230.

Here, the Helmholtz resonance generated region was adjusted merely by changing the length of the first channel 252, while maintaining the sizes of the first resonance space 242 and the second resonance space 244 and the length and diameter of the second channel 254.

In the graph, the red line indicates a case when the length of the first channel 252 is 0.6 mm, the purple line indicates a case when the length of the first channel 252 is 1.0 mm, the green line indicates a case when the length of the first channel 252 is 1.4 mm, and the blue line indicates a case when the length of the first channel 252 is 1.8 mm.

It can be seen from the graph that the Helmholtz resonance generated position varies with the change of the length of the channel 252.

In the case of the earphone, once the external design of the earpiece 300 is determined, there is a limit to changing the internal space of the earpiece 300, and thus there is also a limit to controlling the Helmholtz resonance point to tune the sound characteristics in the conventional art since the Helmholtz resonance space is defined in the earpiece 300. However, the dynamic receiver according to the present invention has an advantage in that it is possible to finely tune the sound characteristics merely by replacing the protector 200. Moreover, the mold manufacturing cost and the manufacturing cost of the protector are much lower than those of the earpiece 300, such that the present invention consumes less time and money than the conventional art in changing the Helmholtz resonance point.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context dearly indicates otherwise.

With the above range of variations and applications in mind, it should be understood that the present invention is not limited by the foregoing description, nor is it limited by the accompanying drawings. Instead, the present invention is limited only by the following claims and their legal equivalents.

What is claimed is:

1. A dynamic receiver with a resonance protector for an earphone, comprising:

a frame;

a magnetic circuit disposed in the frame;

a vibration system disposed in the frame and configured to generate sound by a mutual electromagnetic force with the magnetic circuit; and a protector coupled to the frame and configured to protect components disposed in the frame, wherein the protector includes a sound emitting hole passing through the protector and emitting sound generated in the frame to the outside, and a resonance space defined on a top surface of the protector, wherein the resonance space is partitioned with the sound emitting hole by a partition wall.

2. The dynamic receiver of claim 1, wherein the resonance space is defined by a recess portion formed on the top surface of the protector.

3. The dynamic receiver of claim 1, wherein the partition wall positioned on an outer periphery of the sound emitting hole has a variable thickness.

4. The dynamic receiver of claim 1, wherein a channel for allowing the resonance space and the sound emitting hole to communicate with each other is defined on the partition wall.

5. The dynamic receiver of claim 1, wherein the protector has one or more resonance spaces.

6. The dynamic receiver of claim 5, wherein a bottom surface of the protector has a curvature corresponding to a curvature of a top surface of the vibration system.

7. A method of manufacturing a dynamic receiver with a resonance protector for an earphone, the method comprising:

disposing a magnetic circuit in a frame;

disposing a vibration system in the frame, the vibration system configured to generate sound by a mutual electromagnetic force with the magnetic circuit; and coupling a protector to the frame, the protector configured to protect components disposed in the frame, the protector including a sound emitting hole passing through the protector and emitting sound generated in the frame to the outside, and a resonance space defined on a top surface of the protector, wherein the resonance space is partitioned with the sound emitting hole by a partition wall.

8. The method of claim 7, further comprising defining the resonance space by a recess portion formed on the top surface of the protector.

9. The method of claim 7, wherein the partition wall positioned on an outer periphery of the sound emitting hole has a variable thickness.

10. The method of claim 7, further comprising defining on the partition wall a channel for allowing the resonance space and the sound emitting hole to communicate with each other.

11. The method of claim 7, wherein the protector has one or more resonance spaces.

12. The method of claim 11, wherein a bottom surface of the protector has a curvature corresponding to a curvature of a top surface of the vibration system.

* * * * *